US009043033B2

(12) United States Patent
Kim et al.

(10) Patent No.: US 9,043,033 B2
(45) Date of Patent: May 26, 2015

(54) NETWORK SYSTEM AND CONTROL METHOD THEREOF

(75) Inventors: Museung Kim, Changwon-si (KR); Minjin Oh, Changwong-si (KR)

(73) Assignee: LG Electronics Inc., Seoul (KR)

( * ) Notice: Subject to any disclaimer, the term of this patent is extended or adjusted under 35 U.S.C. 154(b) by 508 days.

(21) Appl. No.: 13/440,508

(22) Filed: Apr. 5, 2012

(65) Prior Publication Data

US 2012/0265348 A1 Oct. 18, 2012

(30) Foreign Application Priority Data

Apr. 15, 2011 (KR) ..... 10-2011-0035232

(51) Int. Cl.
*F25D 17/04* (2006.01)
*F25D 29/00* (2006.01)

(52) U.S. Cl.
CPC ..... *F25D 17/042* (2013.01); *F25D 29/00* (2013.01); *F25D 2500/06* (2013.01); *F25D 2700/08* (2013.01)

(58) Field of Classification Search
CPC ..... G05B 15/00; G05B 15/02; F25D 17/042; F25D 29/00; F25D 2500/06; F25D 2700/08
USPC ..... 700/275
See application file for complete search history.

(56) References Cited

FOREIGN PATENT DOCUMENTS

| | | |
|---|---|---|
| JP | 2001-291079 | 10/2001 |
| JP | 2004-213215 | 7/2004 |
| JP | 2005-140418 | 6/2005 |
| JP | 2006-227768 | 8/2006 |
| JP | 2006-235667 | 9/2006 |
| JP | 2006-275324 | 10/2006 |
| JP | 2010-217997 | 9/2010 |

OTHER PUBLICATIONS

Toru et al., JP2006275324 (machine translation), pp. 1-14.*
Rie et al., JP2006235667 (machine translation), pp. 1-15.*
Yoichi et al., JP2005140418 (machine translation), pp. 1-10.*
Seiichiro et al., JP2001291079 (machine translation), pp. 1-50.*
Japanese Office Action for Application 2012-092112 dated Nov. 20, 2013.
Japanese Office Action for Application 2012-092112 dated May 1, 2013.

* cited by examiner

*Primary Examiner* — Kenneth Lo
*Assistant Examiner* — Derrick Boateng
(74) *Attorney, Agent, or Firm* — KED & Associates LLP

(57) ABSTRACT

A network system may be provided that includes an electronic product, a recognition target, a recognition device, a setting program and a display unit. The electronic product may operate to manage or process a target. The recognition target may include information relating to the target. The recognition device may recognize information listed on the recognition target. The setting program may convert information recognized by the recognition device into setting information. The display unit may display the setting information converted by the setting program.

5 Claims, 7 Drawing Sheets

NETWORK SYSTEM AND CONTROL METHOD THEREOF

CROSS-REFERENCE TO RELATED APPLICATION

The present application claims priority from Korean Patent Application No. 10-2011-0035232, filed Apr. 15, 2011, the subject matter of which is hereby incorporated by reference.

BACKGROUND

1. Field

Embodiments may relate to a network system and a control method thereof.

2. Background

Electronic products may be devices for managing or processing specific targets (or objects) by using electricity as a power source.

For electronic products, it may be inconvenient for a user to memorize or search each management information or processing information on the specific targets (or objects).

As one example, if an electronic product is a refrigerator, a user may need to memorize management information (such as amount of storage or expiration dates) of foods stored in the refrigerator. That is, the user may feel inconvenient when consuming foods have approaching expiration dates or making a plan for purchasing foods that have small remaining amounts.

If an electronic product is a washing machine, before washing the laundry, a user may feel uncomfortable to confirm materials or washing types of the laundry one by one in order to operate the washing machine.

If an electronic product is a cooking appliance, before cooking food, a user may feel uncomfortable to confirm cooking courses of the food one by one in order to operate the cooking appliance.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made to arrangements and embodiments of the present disclosure, examples of which may be illustrated in the accompanying drawings. As used hereinafter, the word target may refer to an object such as food, clothing and/or ingredient.

Figure 1:
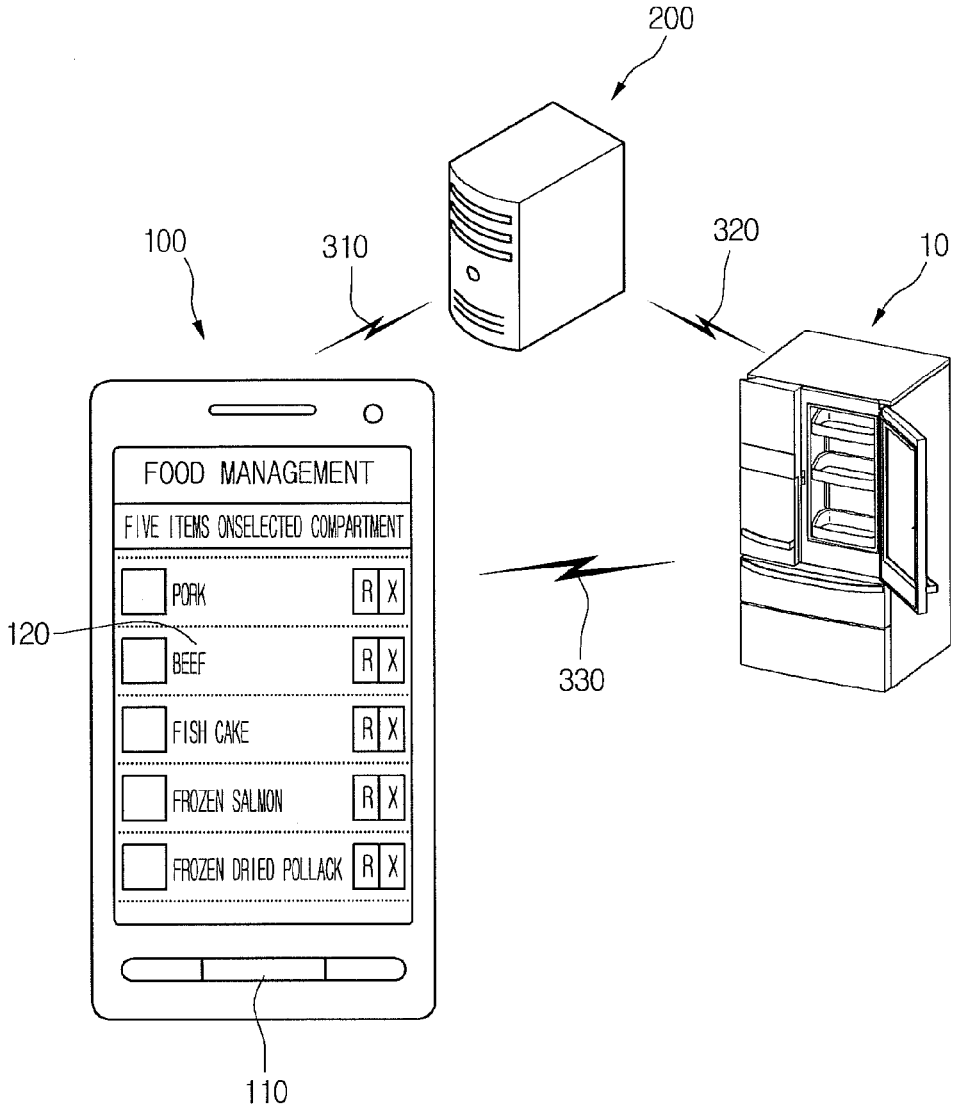
FIG. 1 is a view of a network system according to a first embodiment.
Figure 2:
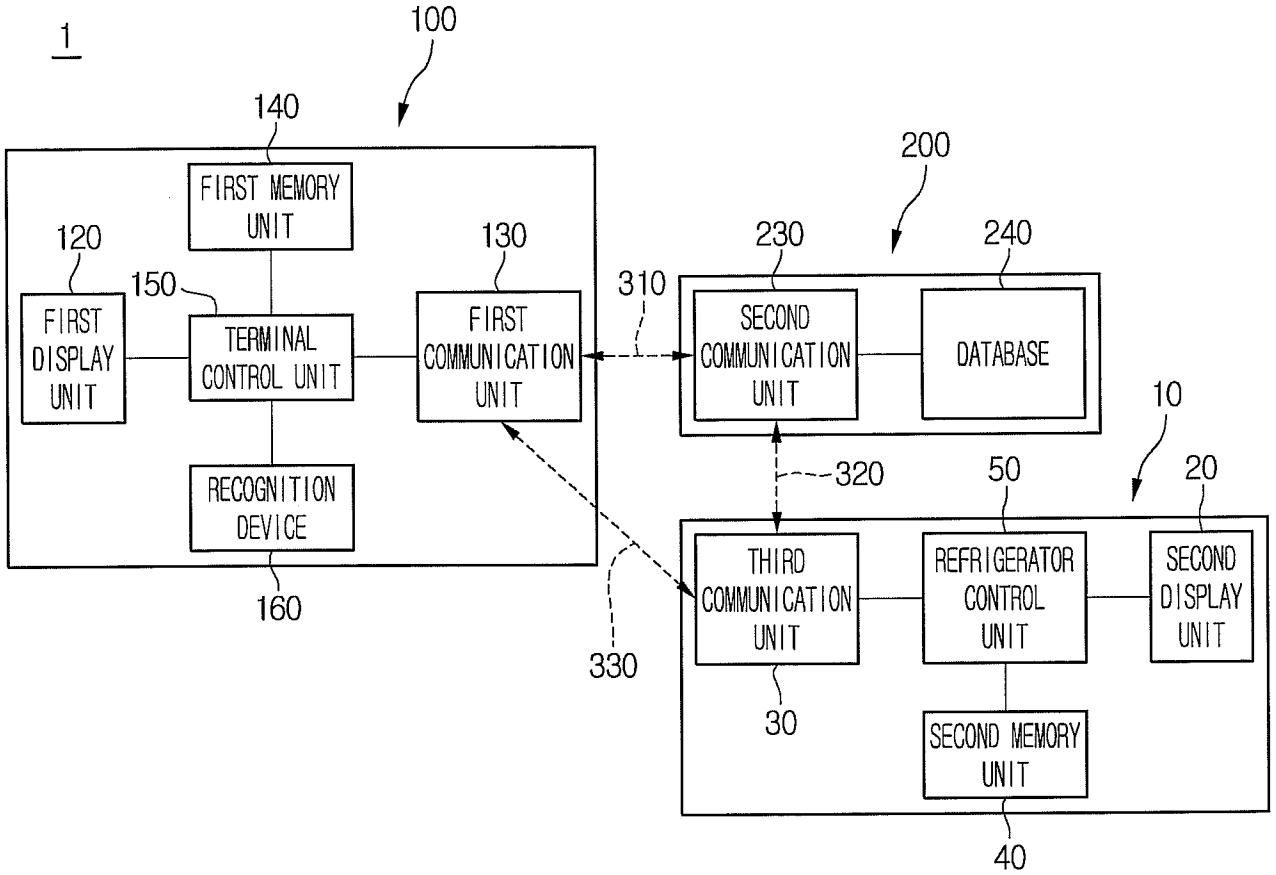
FIG. 2 is a block diagram of a network system according to the first embodiment.

FIG. 1 is a view of a network system according to a first embodiment. FIG. 2 is a block diagram of a network system according to the first embodiment. Other embodiments and configurations may also be provided.

As shown in FIGS. 1 and 2, a network system 1 may include a refrigerator 10, a terminal 100 and a server 200. The refrigerator 10 may be an electronic product for storing a target (e.g., food) with cool air. The terminal 100 may recognize (or determine) information relating to the food in a communication enabled connection with the refrigerator 10. The server 200 may store predetermined data in a communication enabled connection with the refrigerator 10 and the terminal 100.

The terminal 100 may be a mobile terminal, cellular phone or smart phone, for example.

The terminal 100 may include an input unit 110 and a first display unit 120. The input unit 110 may be for inputting a predetermined command relating to the food stored in the refrigerator 10. The first display unit 120 may be for displaying information relating to the food.

The network system 1 may include a first interface 310 (or communication interface) between the terminal 100 and the server 200, a second interface 320 (or communication interface) between the server 200 and the refrigerator 10, and a third interface 330 (or communication interface) between the terminal 100 and the refrigerator 10.

At least one communication type of WiFi, Zig-bee, Bluetooth, and internet may be applied to the first to third interfaces 310, 320, and 330 to deliver information.

As shown in FIG. 2, the terminal 100 may include a first display unit 120, a first communication unit 130, a first memory unit 140, a terminal control unit 150 and a recognition device 160. The first communication unit 130 may be for a communication enabled connection to the refrigerator 10 or the server 200. The first memory unit 140 may be for storing information delivered from the first communication unit 130 or operating information of the terminal 100. The recognition device 160 may be for recognizing (or determining) information relating to the food stored in the refrigerator 10. The terminal control unit 150 may be for controlling an operation of the terminal 100.

The server 200 may include a second communication unit 230 for a communication enabled connection to the first communication unit 130, and a database 240 for storing information relating to the food stored in the refrigerator 10.

The refrigerator 10 may include a second display unit 20, a third communication unit 30, a second memory unit 40 and a refrigerator control unit 50. The third communication unit 30 may be for a communication enabled connection to the first communication unit 130 or the second communication unit 230. The second display unit 20 may be for displaying information relating to the food. The second memory unit 40 may be for storing information relating to the food. The refrigerator control unit 50 may be for controlling an operation of the refrigerator 10.

The information relating to the food may include food (itself) information and/or food management information. The food (itself) information may include a food name, an amount of food, and/or a number of foods. The food management information may include a storage location, a storage period, an amount of storage, and/or a storage type of the food stored in the refrigerator 10.

The information relating to the food may be obtained through a predetermined recognition target. The recognition target may include a receipt, a food container, and/or encrypted information.

The first memory unit 140, the second memory unit 40, and/or the database 240 may store the information relating to the food. Additionally, information stored in one of the first memory unit 140 or the second memory unit 40 may be synchronized with another memory unit. The first memory unit 140, the second memory unit 40, and the database 240 may collectively be called a storage device.

When the first memory unit 140 and the second memory unit 40 operate in synchronization, the database 240 of the server 200 may be used. The first memory unit 140 and the second memory unit 40 may be synchronized when the terminal 100 and the refrigerator 10 are directly communicating to each other. Information recognized through the terminal 100 may be delivered to the server 20 to be transmitted to the refrigerator 10, or may be directly transmitted to the refrigerator 10.

Information stored in the database 240 (of the server 200), and/or information not stored in the terminal 100 or the refrigerator 10 may be transmitted to the terminal 100 or the refrigerator 10. That is, the terminal 100 or the refrigerator 10 may download or update information on the database 240.

Figure 3:
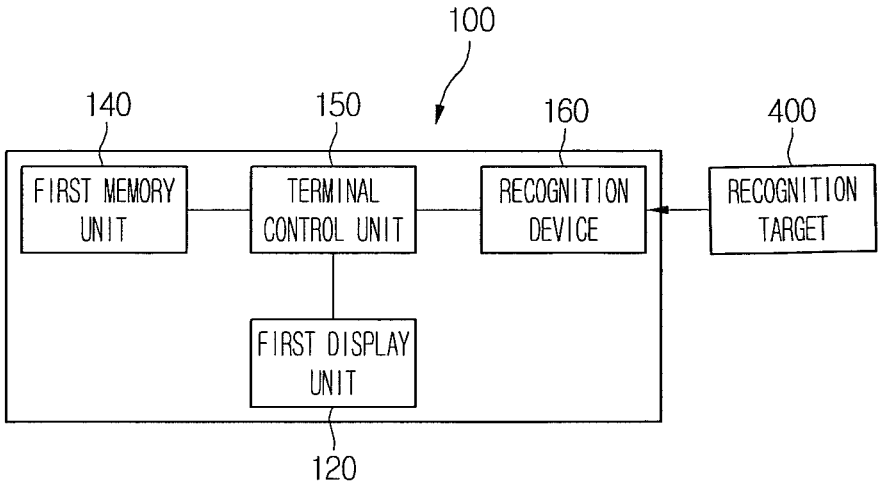
FIG. 3 is a block diagram of a terminal and a recognition target according to the first embodiment.
Figure 4:
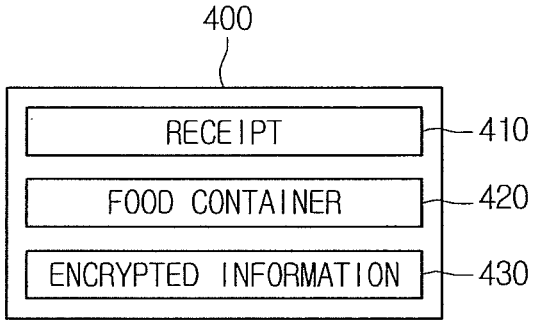
FIG. 4 is a block diagram of a recognition target according to the first embodiment.

FIG. 3 is a block diagram of a terminal and a recognition target according to the first embodiment. FIG. 4 is a block diagram of a recognition target according to the first embodiment. Other embodiments and configurations may also be provided.

FIGS. 3 and 4 show that the terminal 100 may further include a recognition device 160 for recognizing a recognition target 400 (or for determining information on the target).

The recognition device 160 may recognize (or determine) predetermined information included in the recognition target 400. The recognition device 160 may be a consumable reader or a consumable holder. Consumable (or consumable object) may be understood as food stored in a refrigerator. A reader may be a device for reading information on a consumable object. A holder may be a device for including (containing), maintaining, and/or supporting the food therein.

The consumable reader may be a capturing device (such as a camera), an RFID reader, and/or a bar-code reader, for example. The consumable holder may be a shelf and/or a basket, for example. The shelf or the basket may include a weight sensor for sensing and reading weight of food. The weight sensor may be a consumable reader that senses predetermined information on a consumable object, or the weight sensor may be a consumable holder that supports a consumable object.

The recognition target 400 may include a receipt 410 having a predetermined character, symbol, number, shape, color, and/or design. The character, symbol, shape, color, and design may altogether be considered promised information.

The recognition target 400 may further include a food container 420 for receiving food therein. The food container 420 may include the promised information.

The recognition target 400 may further include encrypted information 430 that is encrypted by a predetermined rule. The encrypted information 430 may be information relating to the food. The encrypted information 430 may include a bar-code, a QR code, and/or an RFID tag, for example. The encrypted information 430 may be included in the receipt 410 or the food container 420.

Information provided (or listed) on the recognition target 400 may be recognized (or determined) by the recognition device 160. The promised information may be recognized (or determined) by a camera, and the encrypted information 430 may be recognized (or determined) by a camera, a bar-code reader, and/or an RFID, for example.

Figure 5:
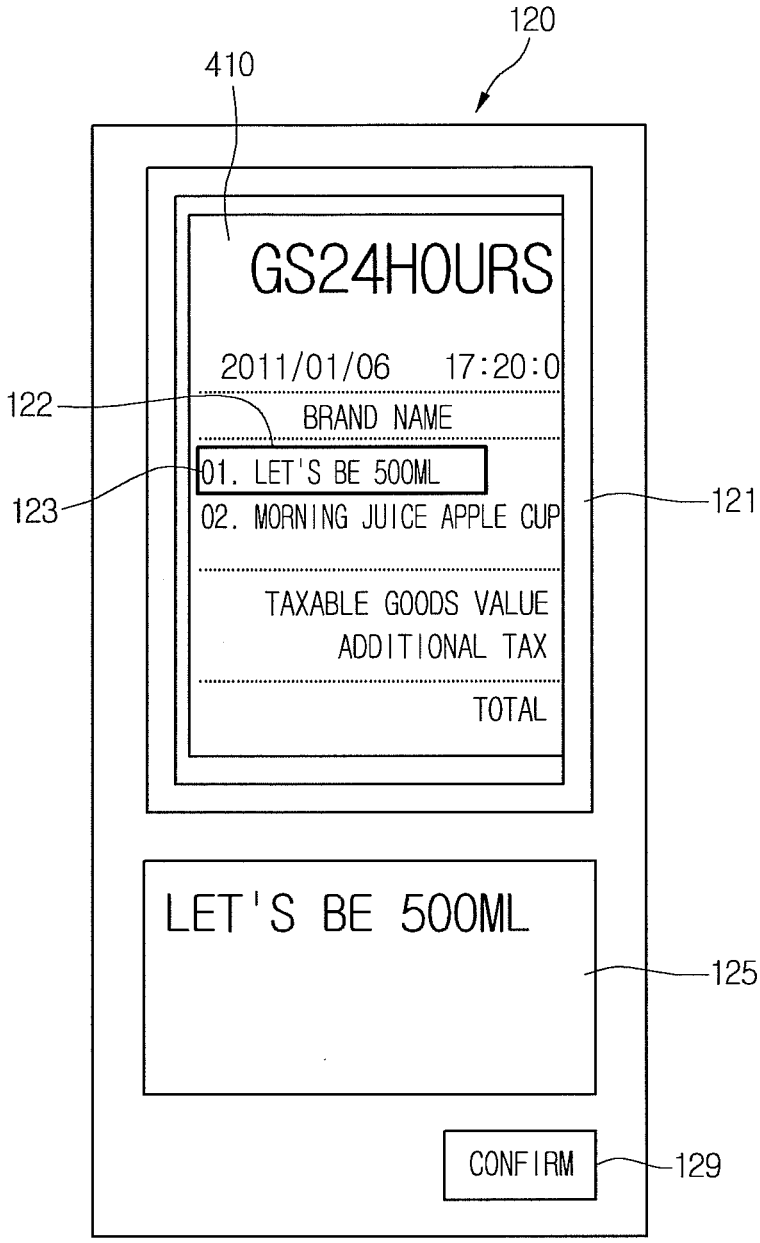
FIG. 5 is a view of a display unit in a terminal when a recognition target is a receipt.

FIG. 5 is a view of a display unit in a terminal when a receipt is a recognition target. Other embodiments and configurations may also be provided.

As shown in FIG. 5, the first display unit 120 (of the terminal 100) may display the receipt 410 that is recognized by the recognition device 160.

The first display unit 120 may include an image display unit 121 and a text display unit 125. The image display unit 121 may be for displaying an image obtained by the recognition device 160. The text display unit 125 may be for displaying information relating to the image display unit 121 as text.

A camera may be one example of the recognition device 160. The camera may be turned on and may be positioned on the receipt 410. The image display unit 121 may display an image recognized by the camera.

The image display unit 121 may include a recognition area 122 for recognizing (or determining) at least one information from among a plurality (or number) of information listed on the receipt 410, and a frame 123 for setting the recognition area 122 as a specific area. The frame 123 may be a predetermined symbol having a rectangular shape displayed on the frame part for setting the recognition area 122.

A user may move the terminal 100 to an appropriate position in order to allow the frame 123 to correspond to a position of specific information listed on the receipt 410. That is, an area having the specific information may be matched to the recognition area 122.

After such a matching, if a confirmation input unit 129 (or confirm button) is pressed or a setting time elapses, then specific information listed (or provided) on the recognition area 122 (e.g. the above promised information) may be recognized or determined. Moreover, information necessary for food management may be extracted by interpreting the recognized information (e.g., an image), and then the information may be displayed on the text display unit 125. The recognized information may be stored in the first memory unit 140 or the database 240.

Additionally, in order to interpret the recognized information, the terminal 100 or the server 200 may include a built-in information recognition program. The information recognition program may interpret the recognized information (e.g., an image) and convert it into food related information corresponding to the recognized information.

The converted food related information may be displayed at the text display unit 125. The displayed information may include food (itself) information (such as food names and an amount of food) or food management information (such as expiration dates). In relating to the food recognized in the receipt 410, the food (itself) information or the food management information may be stored in advance in the first memory unit 140 or the database 240.

Figure 6:
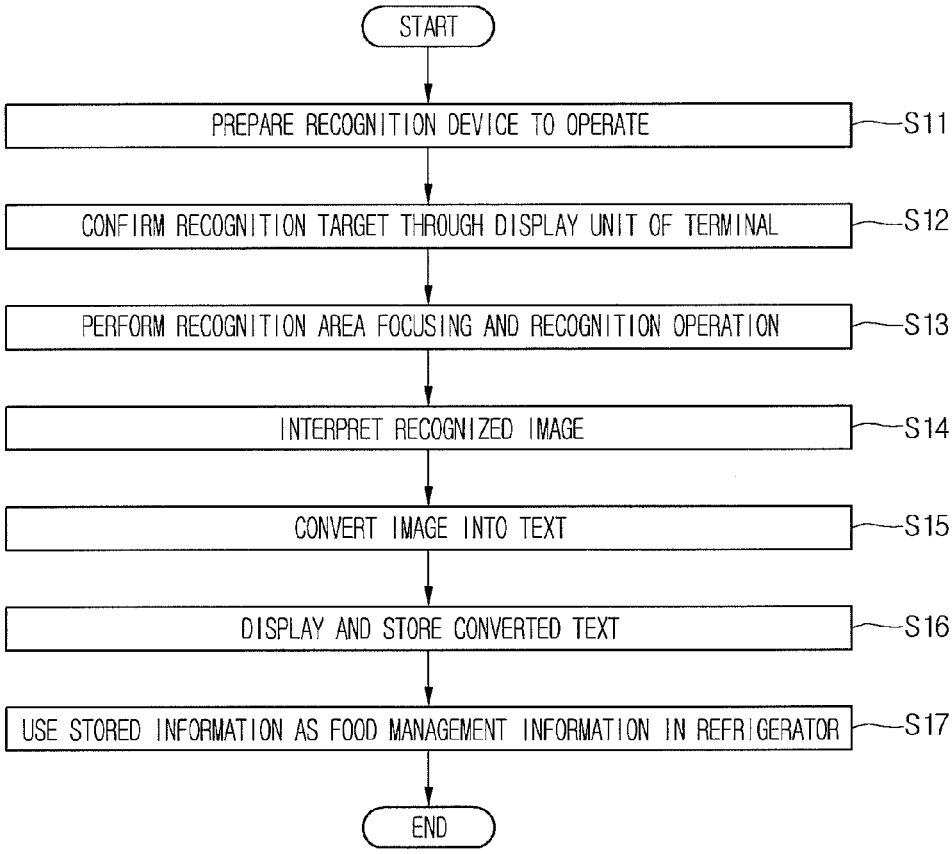
FIG. 6 is a flowchart of a method of operating a recognition device according to a first embodiment.

FIG. 6 is a flowchart of a method of operating a recognition device according to the first embodiment. Other operations, orders of operations and embodiments may also be provided.

In operation S11, the recognition device 160 may be prepared to operate by operating the terminal 100. The recognition target 400 may be confirmed by the first display unit 120 in operation S12. The recognition area 122 may be focused through the frame 123, and a recognition operation (e.g. a capturing operation) may be performed to obtain (or recognize) an image.

The recognized image may be interpreted using the information recognition program in operation S14. The interpreted image may be converted into a text based on the interpreted information in operation S15.

The converted text may be displayed on the text display unit 125, and may be stored in the first memory unit 140 or the database 240 in operation S16. Information on the converted text may be synchronized with the refrigerator 10, and may then be displayed on the second display unit 20 in operation S16.

The information stored in the first memory unit 140, or the database 240 may be synchronized with the second memory unit 40 (of the refrigerator 10) and may then be used as food management information in operation S17. As one example, when food information that is to be stored in the refrigerator 10 is recognized through a control of the recognition device 160, the recognized food information may be stored in the terminal 100, the refrigerator 10, and/or the server 200.

More specifically, when it is determined that foods relating to the recognized information are to be included in a management target of the refrigerator 10 (e.g. a predetermined command is inputted to an input unit of the refrigerator 10 or the terminal 100), the determined information may be stored in the first memory unit 140, the second memory unit 40, and/or the database 240.

While the food is stored (entered) in the refrigerator 10, information relating to a storage position or a storage period of the food may be additionally recognized or determined (through manual input or automatic recognition), and the additionally recognized information may be stored to relate to a corresponding food. The automatic recognition may be accomplished by at least one of the consumable reader and/or the consumable holder.

Moreover, when food is taken out from the refrigerator 10, the recognized information and/or additionally-recognized information may be displayed on the first display unit 120 and/or the second display unit 20. Additionally, when the food is completely taken out from the refrigerator 10, the recognized information and/or additionally recognized information may be deleted.

Accordingly, the recognized and stored information in the recognition device 160 may be used for food management. The terminal 100 may perform remote monitoring and/or remote control in order to manage the food stored in the refrigerator 10.

Figure 7:
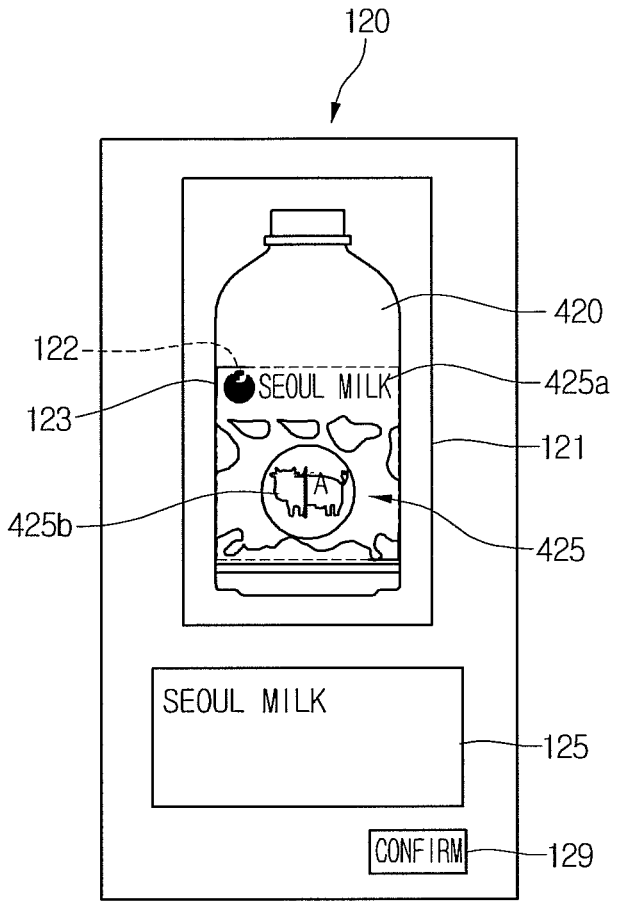
FIG. 7 is a view of a display unit in a terminal when a recognition target is a food container according to the first embodiment.

FIG. 7 is a view of a display unit in a terminal when a recognition target is a food container according to the first embodiment. Other embodiments and configurations may also be provided.

With reference to FIG. 7, the first display unit 120 may display information relating to a corresponding food after a food container 420 is recognized as a recognition target (or determined to be the recognition target).

More specifically, the first display unit 120 may include the image display unit 121 for displaying an image of the food container 420, and the text display unit 125 for displaying information relating to the image display unit 121, which is obtained by converting the recognized image into a text.

The food container 420 may include information relating to a corresponding food (e.g. a brand 425). More specifically, the brand 425 may include a text part 425*a* displayed with a predetermined character, and a design part 425*b* displayed with a predetermined color or design. As one example, the text part 425*a* may include information relating to a food name, and the design part 425*b* may include a logo of the corresponding food or a logo of a manufacturer.

As described with reference to FIG. 5, the frame 123 may be positioned on the food container 420 by using the terminal 100 in order to set the recognition area 122. After a setting time elapses or the confirmation input unit 129 is pressed (or input), a recognition operation (e.g., capturing) may be performed, and information of the text part 425*a* and the design part 425*b* in the recognition area 122 may be recognized or determined.

The recognized information may be interpreted through the information recognition program. Data relating to the brand 425 may be previously stored in the database 240, the first memory unit 140, and/or the second memory unit 40. That is, the recognized image may be matched to the previously stored image so that a corresponding food may be determined.

Since the information provided on the text part 425*a* and the design part 425*b* (i.e., a number of information) is combined and recognized, reliability of determining a food may be improved. That is, if only the information listed on the text part 425*a* is interpreted, another food similar to this food may be matched, but if all the information listed on the text part 425*a* and the design part 425*b* is interpreted, then a matching possibility of a corresponding food may be increased.

Relating to food, the interpreted or determined result may be converted into a text, and may then be displayed on the text display unit 125.

The recognized information of the text part 425*a* and the design part 425*b* or the interpreted result information may be stored in the first memory unit 140, the second memory unit 40, and/or the database 240, and the stored information relating to the food may be used for food management of the refrigerator 10.

The terminal 100 may also recognize or determine the encrypted information 430 as being a recognition target. As discussed above, the encrypted information 430 may include a bar-code, a QR code, and/or an RFID tag. The encrypted information 430 may be provided on the receipt 410 or the food container 420.

In order to recognize the encrypted information 430, the recognition device 160 may include a camera and/or a predetermined reader, for example.

The encrypted information 430 may be recognized (or determined) by using the recognition device 160, and information relating to a specific food may be recognized or determined based on the recognized information. The first memory unit 140, the second memory unit 40, and/or the database 240 may previously store the encrypted information 430 and/or information relating to the food corresponding thereto.

The information relating to a specific food may be displayed by the terminal 100 or the refrigerator 10. Additionally, if the specific food is included as a management target of the refrigerator 10, the information recognized by the recognition device 160 together with additional information relating to the specific food may be used for food management of the refrigerator 10.

A second embodiment and a third embodiment may now be described. Reference numbers and/or descriptions of the first embodiment may be cited with respect to same parts as the first embodiment.

Figure 8:
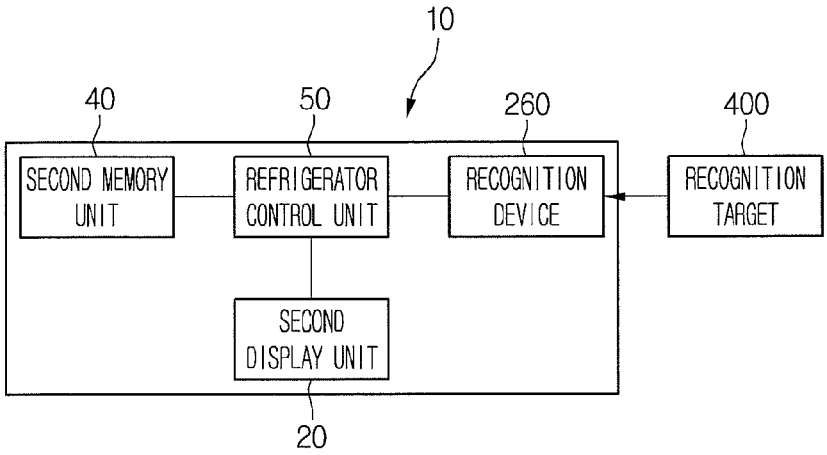
FIG. 8 is a block diagram of a refrigerator and a recognition target according to a second embodiment.

FIG. 8 is a block diagram of a refrigerator and a recognition target according to a second embodiment. Other embodiments and configurations may also be provided.

FIG. 8 shows that the refrigerator 10 may include a recognition device 260 for recognizing the recognition target 400 (or recognition object). The refrigerator 10 may include a camera, a bar-code reader, and/or an RFID reader. That is, the recognition device 260 (in the refrigerator 10) may directly recognize (or determine) information included in the recognition target 400 without using the terminal 100. Foods to be stored in the refrigerator 100 may be managed based on recognized information.

The recognized food related information may be stored in the server 200 or the terminal 100. The terminal 100 may perform remote monitoring or remote control in order to manage the food stored in the refrigerator 10.

Figure 9:
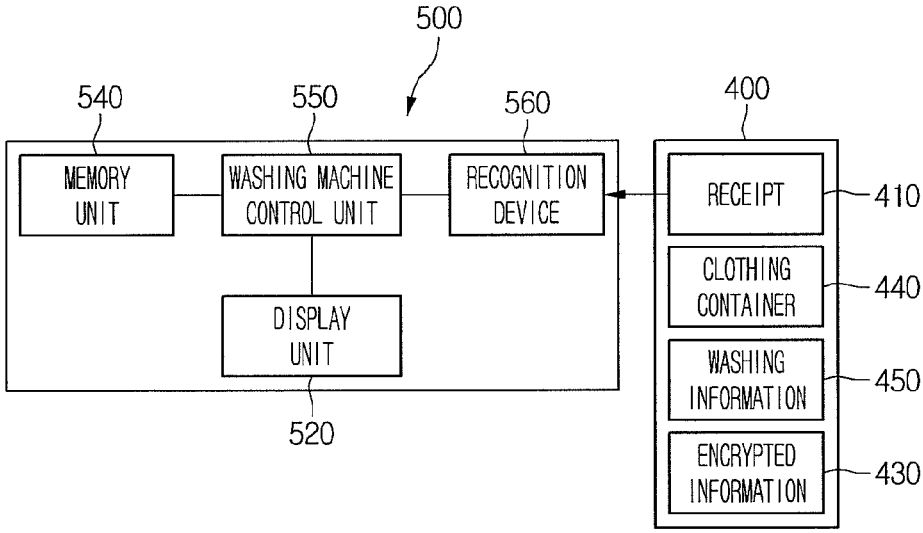
FIG. 9 is a block diagram of a washing machine and a recognition target according to a third embodiment.

FIG. 9 is a block diagram of a washing machine and a recognition target according to a third embodiment. Other embodiments and configurations may also be provided.

FIG. 9 shows that the network system 1 may include a washing machine 500 as an electronic product for processing a target (i.e., clothing). The processing may include washing, dewatering and/or drying. The washing machine 500 may be connected for communication with the terminal 100 or the server 200.

The washing machine 500 may include a display unit 520, a memory unit 540, a washing machine control unit 550 and a recognition device 560. The memory unit 540 may store information relating to clothing (hereinafter clothing information) as a washing target and information relating to a processing course corresponding to the information relating to clothing (hereinafter course information). The display unit 520 may display an operational status of the washing machine 500, the clothing information, and/or the course information. The washing machine control unit 550 may control an operation of the washing machine 500.

The washing machine 500 may further include the recognition device 560 for recognizing (or determining) the recognition target 400. Description on types of the recognition device 560 and its functions may be cited with respect to the first embodiment.

The recognition target 400 that the recognition device 560 recognizes may include the receipt 410 having clothing purchase information, a clothing container 440 for receiving clothing therein, washing information 450 having clothing processing information included in the clothing, and/or the encrypted information 430 for representing clothing related information with a predetermined encryption.

The recognition target 400 may display the information relating to clothing that the washing machine 500 is to process. The information relating to clothing may include information on clothing (itself) or information on clothing processing. As one example, the clothing (itself) information (or clothing related information) may include information relating to clothing composition and/or clothing material, and the clothing processing information may include clothing washing information, dewatering information, and/or drying information.

The clothing related information may be displayed using the promised information (e.g., character, symbol, number, shape, color, or design) described in the first embodiment, and/or an encrypted symbol. Such a promised information or encrypted symbol may be displayed on the receipt 410 and the clothing container 440, and may be included in the washing information 450 and the encrypted information 430.

Additionally, when the displayed clothing related information is determined by the clothing processing information (e.g. input is made on the confirmation input unit), the determined information may be stored in the memory unit 540.

Once the clothing related information is recognized by the recognition device 560, the recognized information may be displayed on the display unit 520 or a display unit of the terminal 100. A user may confirm the information displayed on the display unit 520.

Additional information relating to the clothing processing may be recognized or determined through various input methods (e.g., manual input and automatic recognition). As one example, when the recognized information relating to clothing is a wool knit, additional information on a washing method may be recognized. The additional information may include washing water temperature, detergent input, the amount of detergent, or dewatering intensity.

A user may select at least one of the washing methods, or the washing machine control unit 550 may recommend a proper washing method based on the recognized clothing information.

Since the clothing related information is recognized or determined by the recognition device 560, and the recognized information may be used as the clothing processing information, ease of use may be increased, and operating the washing machine 500 in a wrong way may be prevented (or reduced).

A cooking appliance may also be an electronic product. Ingredients to be cooked by the cooking appliance may be considered as a target. Additionally, a receipt including a purchase list of the ingredients or a cooking container for receiving the ingredients may be a recognition target.

Information relating to the ingredients may be recognized by a method of the first and second embodiments, and an operation (e.g., processing the ingredients) of the cooking appliance may be accomplished based on the recognized information.

In order for an operation of the cooking appliance, additional information relating to ingredients may be recognized or determined, and an operational course of the cooking appliance may be selected or recommended based on the recognized additional information.

Information on a specific target used in an electronic product may be confirmed, and the specific target may be efficiently managed and processed according to the confirmed information.

Since an electronic product or a terminal includes a recognition device, a receipt, information listed on a food container, and/or encrypted information may be recognized. Therefore, information recognition on a specific target may be easily accomplished.

Based on the information recognized by the recognition device, a target may be managed and processed in correspondence to a property of an electronic product. Thus, errors on managing or processing the target may be reduced.

Additionally, since information on a target may be recognized by an electronic product or a terminal without depending on a user's memory or performing an additional recognition process, ease of use may be increased.

Embodiments may provide a network system for efficiently managing and processing a target by easily recognizing information on the target that is to be managed or processed by an electronic product.

A network system may include: an electronic product operating to manage or process a target; a recognition target including information relating to the target; and a recognition device operating to recognize information listed on the recognition target. The network system may further include: a storage device for storing information recognized by the recognition device in order for managing or processing the target; a setting program executed to convert the information recognized by the recognition device into setting information; and a display unit (or display) for displaying the setting information converted by the setting program.

A method of controlling a network system may include: obtaining image information having information relating to a target through a consumable reader; recognizing necessary information for managing or processing the target from the obtained image information; displaying the necessary information; determining whether the displayed information is included for managing or processing the target; and storing information including the determination result in a storage device.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A network system comprising:

a refrigerator to manage a food, and the refrigerator including a first communication device and a first display;

a mobile device including a recognition device and a second display, the recognition device to recognize an image, on a receipt, of at least one letter for a name of the food;

a second communication device provided at the mobile device, and the second communication device to communicate with the first communication device;

a storage device to store the image of the at least one letter recognized by the recognition device in order to manage the food;

a setting program to convert the image of the at least one letter recognized by the recognition device into a text of the at least one letter; and wherein the second display includes:

an image display unit to display the image of the at least one letter obtained by the recognition device, and the image display unit having a frame for setting, as a recognition area, a predetermined setting area in which the image of the at least one letter is located, and a text display unit to display the text of the at least one letter converted by the setting program, wherein the frame of the image display unit has a closed line defining the recognition area and the image of the at least one letter within the closed line is obtained by the recognition device, wherein the text of the at least one letter is transmitted to the first communication device via the second communication device and is displayed on the first display.

2. The network system according to claim 1, further comprising:

a server having a communication enabled connection with the mobile device or the refrigerator, and the server to store the recognized image or the text of the at least one letter.

3. The network system according to claim 1, wherein the recognition device includes at least one of a camera, a barcode reader, or an RFID reader, and the recognition device to obtain image information from the image of the at least one letter.

4. The network system according to claim 1, wherein the setting program is an information recognition program for converting image information recognized from the image of the at least one letter into text information.

5. A method of controlling a network system, comprising:

obtaining an image from a receipt on which at least one letter for a name of a food is provided, using a recognition device of a mobile device;

storing the image of the at least one letter recognized by the recognition device in order to manage the food;

converting the image of the at least one letter recognized by the recognition device into a text of the at least one letter; and displaying, at a mobile display, information relating to the image of the at least one letter and the text of the at least one letter, wherein the mobile display includes:

an image display unit to display the image of the at least one letter obtained by the recognition device, and the image display unit having a frame for setting, as a recognition area, a predetermined setting area in which the image of the at least one letter is located, and a text display unit to display the text of the at least one letter converted by a setting program, wherein the frame of the image display unit has a closed line defining the recognition area and the image of the at least one letter within the closed line is obtained by the recognition device, wherein the text of the at least one letter is transmitted to a refrigerator through a communication device and is displayed on a refrigerator display.

* * * * *